US012410938B2

(12) United States Patent
Atchison et al.

(10) Patent No.: US 12,410,938 B2
(45) Date of Patent: Sep. 9, 2025

(54) DAMPER CONTROL SYSTEMS AND METHODS FOR A ZONING SYSTEM

(71) Applicant: Johnson Controls Technology Company, Auburn Hills, MI (US)

(72) Inventors: Shaun B. Atchison, Wichita, KS (US); Noel A. Grajeda-Trevizo, Newton, KS (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 1529 days.

(21) Appl. No.: 16/359,827

(22) Filed: Mar. 20, 2019

(65) Prior Publication Data

US 2020/0284463 A1 Sep. 10, 2020

Related U.S. Application Data

(60) Provisional application No. 62/815,913, filed on Mar. 8, 2019.

(51) Int. Cl.
*F24F 11/79* (2018.01)
*F24F 110/10* (2018.01)

(52) U.S. Cl.
CPC ..... *F24F 11/79* (2018.01); *F24F 2110/10* (2018.01)

(58) Field of Classification Search
CPC ..... F24F 11/74; F24F 11/755
See application file for complete search history.

(56) References Cited

U.S. PATENT DOCUMENTS

| | | | | |
|---|---|---|---|---|
| 7,156,316 | B2 | 1/2007 | Kates | |
| 7,320,362 | B2 * | 1/2008 | Nichols | G05D 23/1934 165/205 |
| 7,558,648 | B2 | 7/2009 | Hoglund et al. | |
| 2003/0171901 | A1 * | 9/2003 | Salsbury | G06F 17/12 703/2 |
| 2007/0045431 | A1 * | 3/2007 | Chapman | F24F 11/30 236/46 C |
| 2017/0023269 | A1 * | 1/2017 | Gevelber | F24F 11/62 |
| 2017/0299218 | A1 * | 10/2017 | Kojima | F24F 11/76 |

* cited by examiner

*Primary Examiner* — Jianying C Atkisson
*Assistant Examiner* — Meraj A Shaikh
(74) *Attorney, Agent, or Firm* — Fletcher Yoder, PC

(57) ABSTRACT

The present disclosure relates to a heating, ventilation, and/or air conditioning (HVAC) system that includes a controller configured to receive a call for conditioning from each zone of a plurality of zones, where each zone of the plurality of zones includes a damper. The controller is also configured to determine a priority level of each zone of the plurality of zones and to control operation of the HVAC system to sequentially open the dampers of the plurality of zones based on the priority levels of the plurality of zones.

8 Claims, 11 Drawing Sheets

DAMPER CONTROL SYSTEMS AND METHODS FOR A ZONING SYSTEM

CROSS-REFERENCE TO RELATED APPLICATIONS

This application claims priority from and the benefit of U.S. Provisional Application Ser. No. 62/815,913, entitled "DAMPER CONTROL SYSTEMS AND METHODS FOR A ZONING SYSTEM," filed Mar. 8, 2019, which is herein incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and/or air conditioning (HVAC) system may be used to control certain environmental conditions, such as temperature, within a building, home, or other structure. A zoned HVAC system generally includes dampers disposed within ductwork of an air distribution system of a building. The dampers cooperate to regulate air flow within the ductwork and redirect air to specific areas or zones of the building based on a cooling demand of the zones. Accordingly, the dampers facilitate the designation of customized temperature zones throughout the building. That is, the zoned HVAC system may deliver suitably conditioned air to particular zones of the building in order to adequately meet and/or approach a demand for conditioned air in these zones. In many cases, a zone controller or other control unit is used to control and operate the dampers of the HVAC system. Unfortunately, conventional zone controllers are typically inadequate to operate zoned HVAC systems having a relatively large quantity of dampers.

SUMMARY

The present disclosure relates to a heating, ventilation, and/or air conditioning (HVAC) system that includes a controller configured to receive a call for conditioning from each zone of a plurality of zones, where each zone of the plurality of zones includes a damper. The controller is configured to determine a priority level of each zone of the plurality of zones and to control operation of the HVAC system to sequentially open the dampers of the plurality of zones based on the priority levels of the plurality of zones.

The present disclosure also relates to a zoning system for a heating, ventilation, and/or air conditioning (HVAC) system having a plurality of zones, where the zoning system includes a controller configured to receive a first call for conditioning from a first zone that includes a first damper and to receive a second call for conditioning from a second zone that includes a second damper. The controller is also configured to determine a priority level of the first zone and a priority level of the second zone and to control operation of the HVAC system to sequentially actuate the first damper and the second damper based on the priority levels of the first zone and the second zone.

The present disclosure also relates to a control system for a zoned heating, ventilation, and/or air conditioning (HVAC) system including a plurality of zones. The control system includes a controller configured to receive a call for conditioning from two zones of the plurality of zones, where each zone of the two zones includes a damper set. The controller is also configured to determine a priority level of each zone of the two zones and to control operation of the zoned HVAC system to sequentially open the damper sets of the two zones based on the priority levels of the two zones.

BRIEF DESCRIPTION OF THE DRAWINGS

Various aspects of this disclosure may be better understood upon reading the following detailed description and upon reference to the drawings in which.

DETAILED DESCRIPTION

Figure 1:
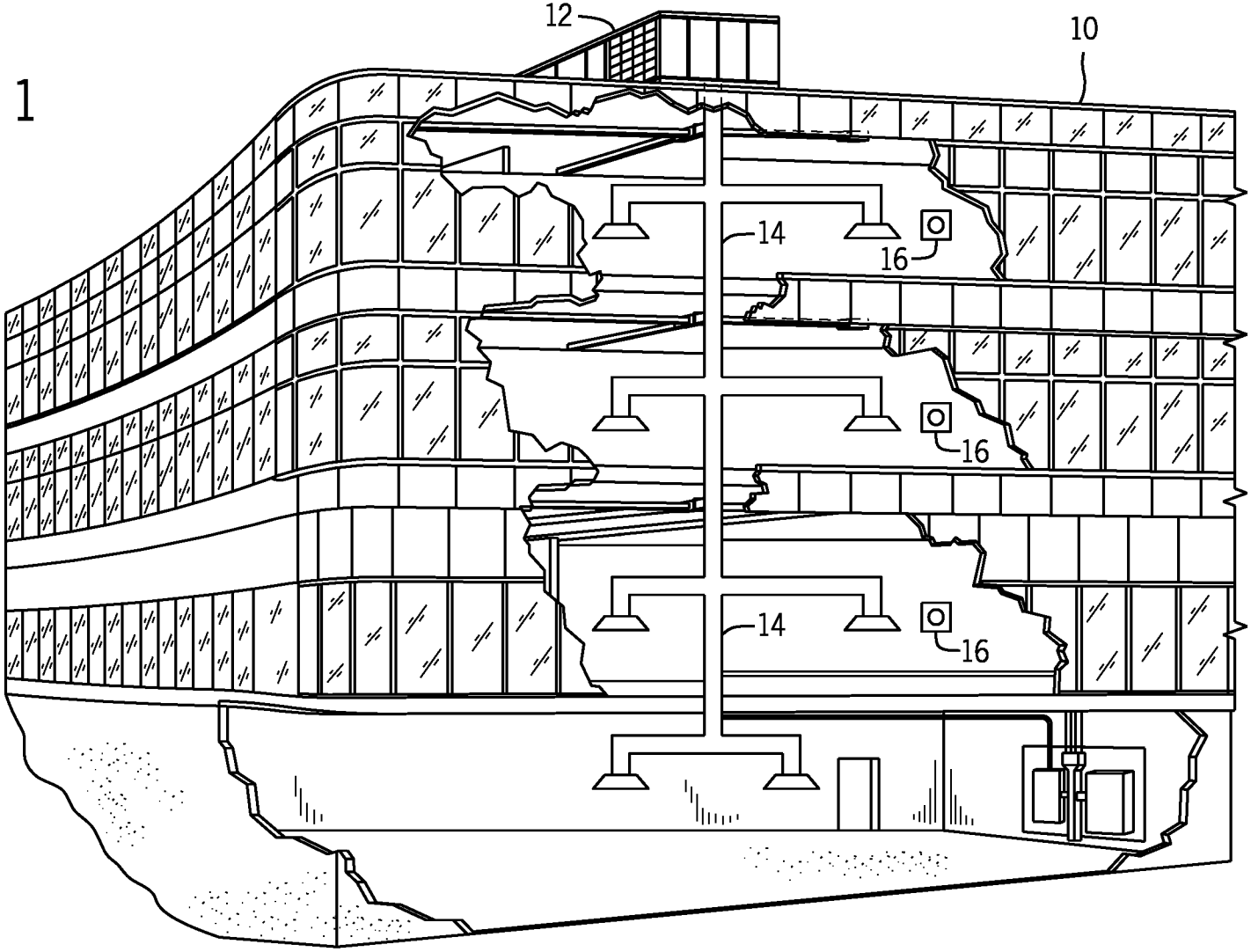
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As noted above, certain HVAC systems may include zoned HVAC systems configured to concurrently regulate separate climate conditions within a plurality of separate spaces or rooms of a building or other structure. These previously-designated spaces or rooms may form zones of the zoned HVAC system. Zoned HVAC systems often utilize a control system to control the operation of various air conditioning devices and/or equipment that enables the independent adjustment of climate parameters within each of the zones. For example, the control system may include a zone controller that is configured to adjust devices of the HVAC system to regulate and/or maintain an air temperature within each zone at a desired setting or within a desired range. Accordingly, the zone controller enables the individual management of climate parameters within the zones.

Zoned HVAC systems generally include a plurality of ducts forming an air distribution system throughout the building. The ducts may include return air ducts and supply air ducts that extend between and fluidly couple air conditioning components of the HVAC system, such as an evaporator and/or a furnace, to the zones of the building. For example, each of the zones may be associated with one or more return air ducts and one or more supply air ducts that enable the HVAC system to receive air from and supply air to a particular zone. Respective dampers may be positioned within each of the return air and/or supply air ducts of the zones and may be configured to regulate a flow rate of return air being drawn from and a flow rate of supply air being directed into the zones. In particular, the dampers may be electrically and/or communicatively coupled to the zone controller, such that the zone controller may operate the dampers to adjust respective positions of the dampers. Accordingly, the zone controller may facilitate distribution of conditioned air amongst zones of the building that may be calling for heating or cooling.

Typical zone controllers generally include a damper support limit that is indicative of a maximum quantity of dampers the zone controller may operate at a particular instance in time. Indeed, hardware and/or software limitations of conventional zone controllers may render the zone controllers inadequate to control an HVAC system having a quantity of dampers that exceeds the damper support limit of the zone controller. Therefore, conventional zone controllers are typically limited for use in HVAC systems that include a total quantity of dampers that is equal to, or less than, the damper support limit of the zone controller. Accordingly, in many cases, multiple zone controllers are implemented to control HVAC systems that include more dampers than permitted by the damper support limit of an individual zone controller. Unfortunately, implementing multiple zone controllers in an HVAC system may complicate assembly and installation of the HVAC system, as well as increase operational and/or maintenance costs associated with the HVAC system.

It is now recognized that enabling an individual zone controller to effectively operate an HVAC system that includes a quantity of dampers that exceeds a quantity of dampers allotted by the traditional damper support limit of the zone controller may reduce manufacturing, assembly, and/or maintenance costs associated with the HVAC system. Accordingly, embodiments of the present disclosure are directed to a control system that, via implementation of a zoning algorithm, may control an HVAC system that includes more dampers than allotted by the damper support limit of the zone controller.

For example, in accordance with present embodiments, the zone controller may be communicatively coupled and/or electrically coupled to a plurality of damper sets of the HVAC system, where each damper set is associated with a particular room or zone of a building. Each of the damper sets may include a total quantity of individual dampers that is equal to, or less than, the damper support limit of the zone controller. The zoning algorithm enables the zone controller to sequentially control the dampers sets based on certain zone parameters when multiple zones send a call for heating or cooling at once. For example, in embodiments where a first zone, a second zone, and a third zone simultaneously send a call for heating or cooling to the zone controller, the zone controller may sequentially control a damper set of the first zone, a damper set of the second zone, and a damper set of the third zone, where each of the dampers sets includes a quantity of individual dampers that is equal to, or less than, the damper support limit of the zone controller. Indeed, by enabling the zone controller to sequentially control the individual damper sets, the zoning algorithm may ensure that the zone controller does not, at a particular instance in time, operate a total quantity of dampers that exceeds the damper support limit of the zone controller. That is, the zoning algorithm may ensure that the zone controller does not operate two or more damper sets simultaneously if a cumulative quantity of individual dampers included in the two or more damper sets exceeds the damper support limit of the zone controller. In this manner, the control system of the present disclosure may enable an individual zone controller to operate an HVAC system that may include more dampers than allotted by the damper support limit of the zone controller. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
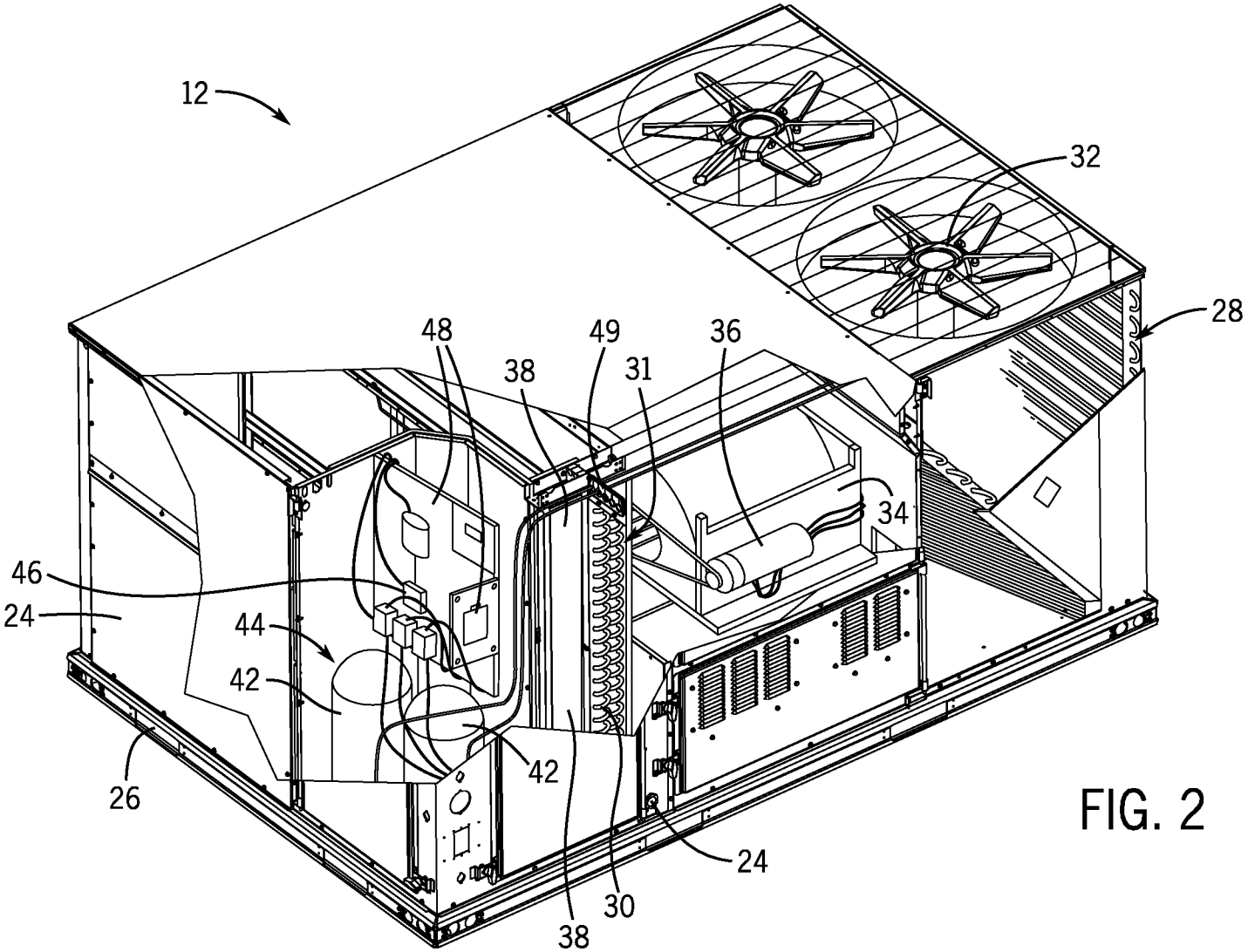
FIG. 2 is a perspective view of an embodiment of a packaged HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
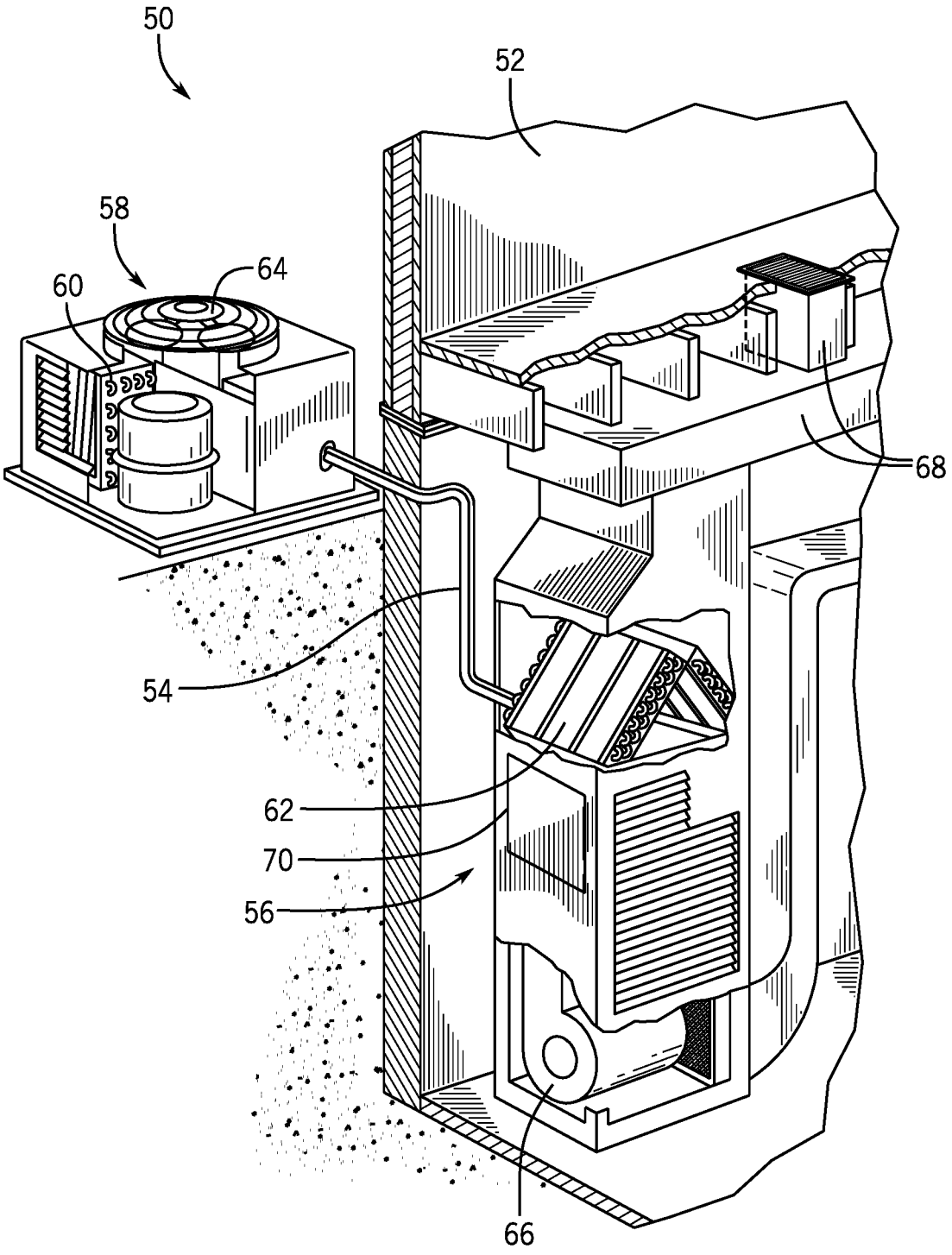
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
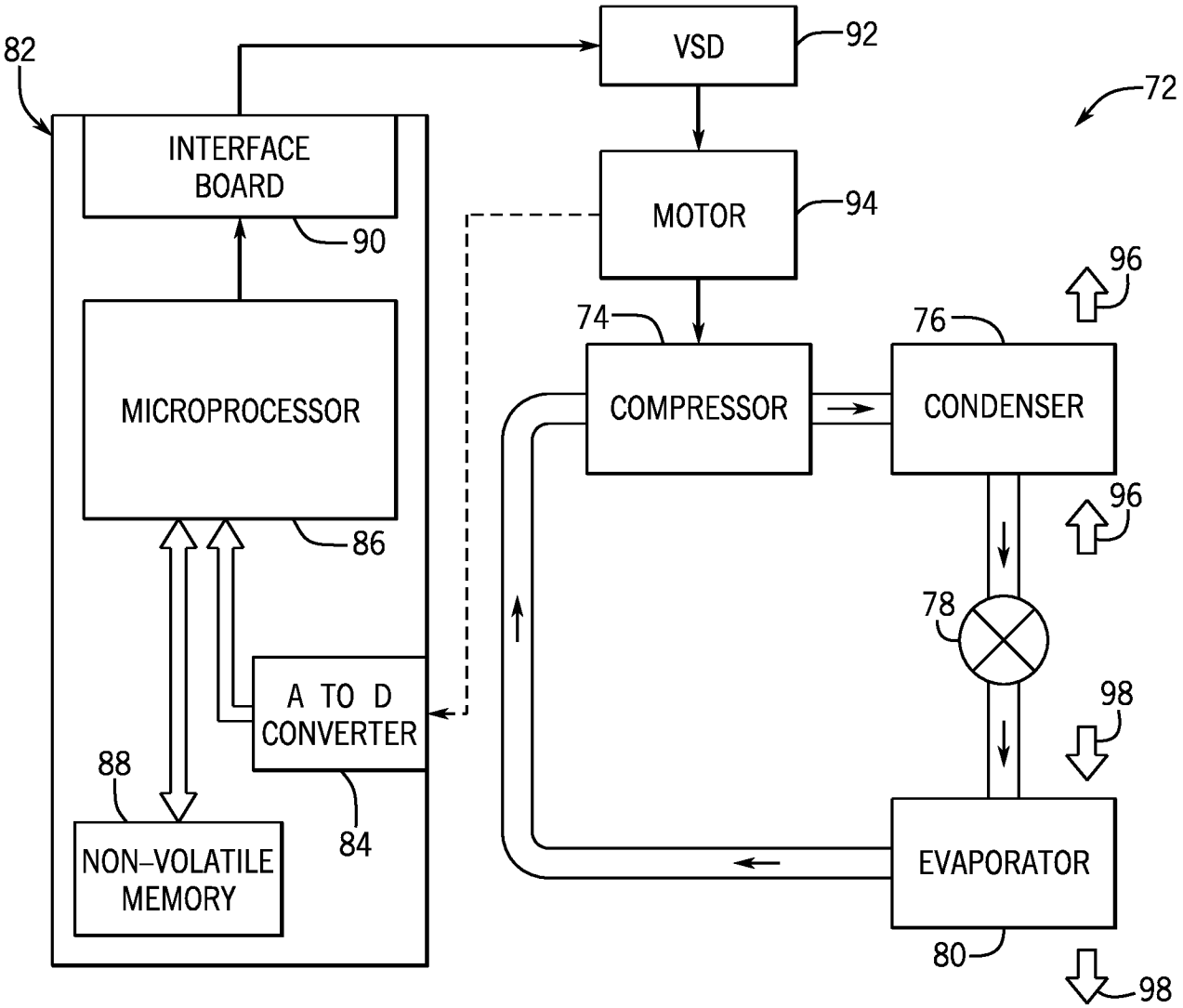
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference to FIGS. 1-4 is intended to be illustrative of the context of the present disclosure. Accordingly, it should be noted that the embodiments of the present disclosure may include features of the description above. As will be discussed in more detail below, embodiments of the present disclosure include a zoned HVAC system having a control system, such as the control device 16, which may be configured to sequentially operate respective damper sets that are associated with particular zones serviced by the zoned HVAC system. More specifically, the control system is configured to sequentially operate the damper sets based on respective priority levels of the zones and/or based on predetermined upper airflow limits associated with the zones.

Figure 5:
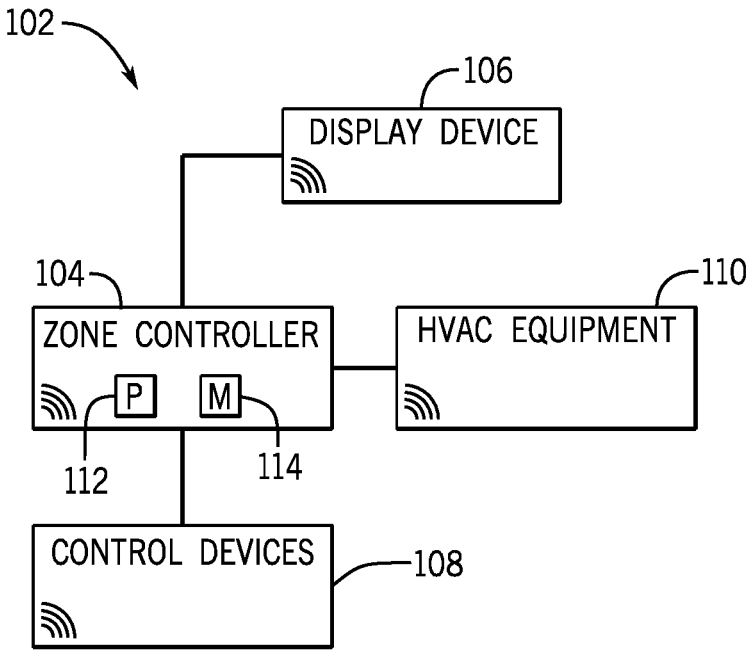
FIG. 5 is a block diagram of an embodiment of a control system that may be used to control a zoned HVAC system, in accordance with an aspect of the present disclosure.

With the foregoing in mind, FIG. 5 is a block diagram of an embodiment of a control system 102 that may be configured to operate any of the HVAC systems of FIGS. 1-4 or any other suitable zoned HVAC system associated with the building 10 or another structure. In the illustrated embodiment, the control system 102 includes a zone controller 104, a display device 106, which may be an input device, and one or more control devices 108, such as one or more thermostats, which may be configured to cooperatively control HVAC equipment 110 of an HVAC system. As discussed in detail below, in some embodiments, the HVAC equipment 110 may include one or more dampers, louvers, or other suitable flow regulation devices that are configured to control airflow into or out of particular zones of the HVAC system.

The zone controller 104 includes a processor 112 and a memory device 114. The processor 112 may be used to execute software, such as software for providing commands and/or data to the control system 102, and so forth. Moreover, the processor 112 may include multiple microprocessors, one or more "general-purpose" microprocessors, one or more special-purpose microprocessors, and/or one or more application specific integrated circuits (ASICS), or some combination thereof. For example, upon installation of the software or other executable instructions on the processor 112, the processor 112 may become a special purpose processor configured to improve operation of the processor 112, operation of an HVAC system, and/or operation of the control system 102 using the techniques described herein. In some embodiments, the processor 112 may include one or more reduced instruction set (RISC) processors. The memory device 114 may include a volatile memory, such as RAM, and/or a nonvolatile memory, such as ROM. The memory device 114 may store a variety of information and may be used for various purposes. For example, the memory device 114 may store processor-executable instructions for the processor 112 to execute, such as instructions for providing commands and/or data to the control system 102 and/or to components of an HVAC system associated with the control system 102.

As described in greater detail herein, in certain embodiments, the processor 112 may generate and display a graphical user interface (GUI) on the display device 106. The GUI enables an occupant, an installer or service technician, or another user to input commands into the control system 102 and to control operation of the control system 102. In some embodiments, the display device 106 may be a component of the zone controller 104, a component of one of the control devices 108, or a control panel screen of an HVAC unit. In other embodiments, the display device 106 may be an external device communicatively coupled to the control system 102. For example, the display device 106 may be a tablet, a mobile device, a laptop computer, a personal computer, a wearable device, and/or the like. The display device 106 may be communicatively coupled to the components of the control system 102 via various wired and/or wired communication devices or techniques.

For example, the zone controller 104, the display device 106, the control devices 108, and/or certain of the HVAC equipment 110 may each have a communication component that facilitates wired or wireless communication between the zone controller 104, the display device 106, the control devices 108, and/or the HVAC equipment 110 via a network. Accordingly, individual components of the control system 102 may communicate with one another via the network. The communication components may include a network interface that enables the zone controller 104, the display device 106, the control devices 108, and/or the HVAC equipment 110 to communicate via various protocols such as EtherNet/IP, ControlNet, DeviceNet, or any other communication network protocol. Alternatively, the communication components may enable the zone controller 104, the display device 106, the control devices 108, and/or the HVAC equipment 110 to communicate via various wireless communication protocols such as Wi-Fi, mobile telecommunications technology, Bluetooth®, near-field communications technology, and the like. As such, the zone controller 104, the display device 106, the control devices 108, and/or the HVAC equipment 110 may wirelessly communicate data between each other.

Figure 6:
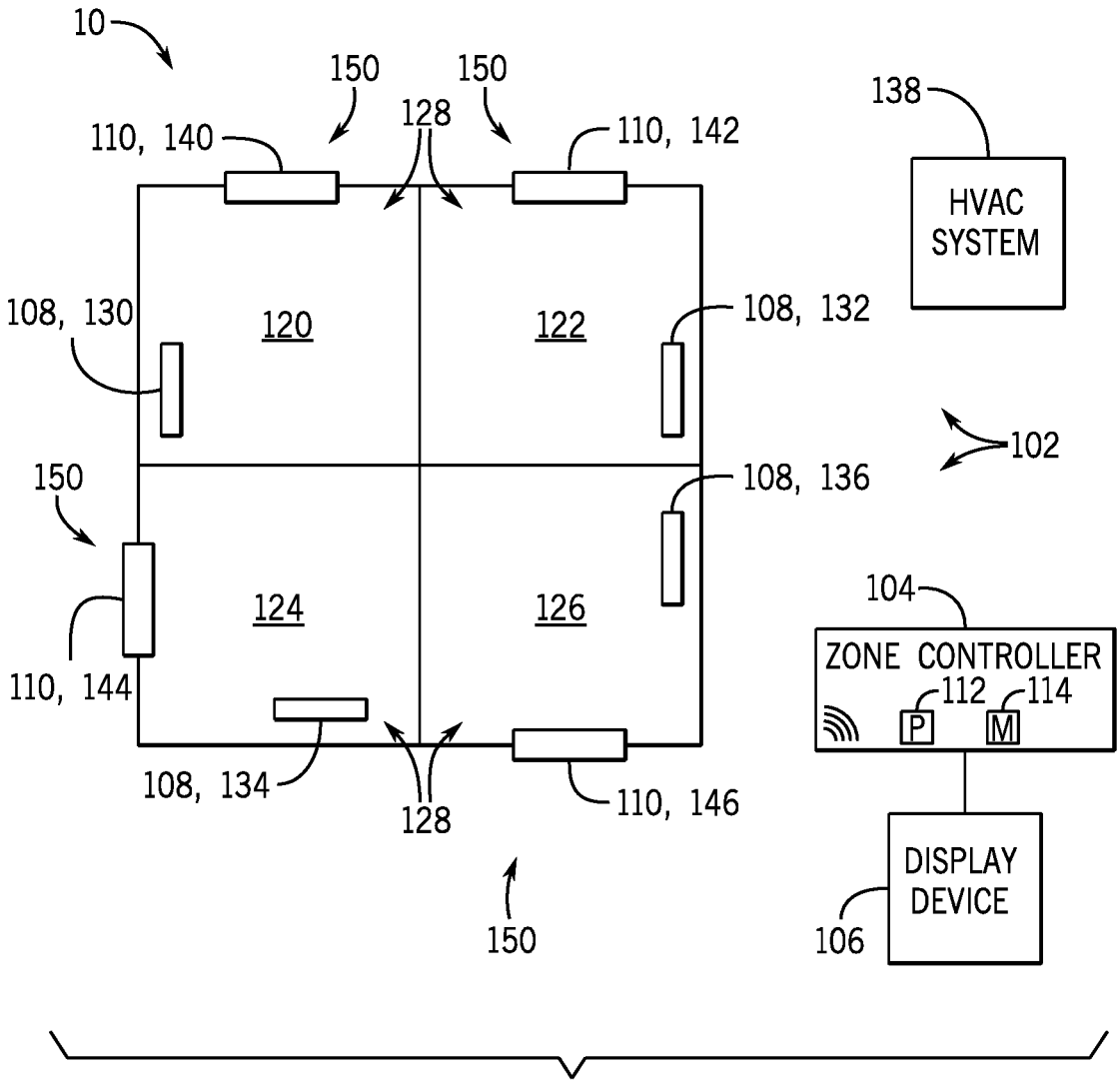
FIG. 6 is a schematic diagram of an embodiment of a building having HVAC equipment that may be controlled by a control system, in accordance with an aspect of the present disclosure.

FIG. 6 is a schematic of an embodiment of the building 10 serviced by the control system 102. As shown in the illustrated embodiment, the building 10 includes a first zone 120, a second zone 122, a third zone 124, and a fourth zone 126, which are collectively referred to herein as zones 128. In some embodiments, each of the zones 128 may be associated with a respective room or space within the building 10. However, it should be understood that, in other embodiments, each of the zones 128 may include 1, 2, 3, 4, 5, 6, or more than 6 rooms. The control devices 108 may include a first control device 130, a second control device 132, a third control device 134, and a fourth control device 136, which are respectively positioned within and/or associated with the first zone 120, the second zone 122, the third zone 124, and the fourth zone 124. Accordingly, the control devices 108 may individually monitor climate parameters, such as temperature, within each of the zones 128.

The zones 128 are supplied with conditioned air generated by an HVAC system 138. It should be appreciated that the HVAC system 138 may include any of the HVAC systems of FIGS. 1-4 or any other suitable HVAC system. The HVAC system 138 includes the HVAC equipment 110, which enables the HVAC system 138 to supply conditioned air to one or more of the zones 128. More specifically, the HVAC equipment 110 enables the HVAC system 138 to concurrently regulate climate parameters within each of the zones 128 of the building 10 via supply or other regulation of air flow to, within, and/or from the zones 128.

For example, in some embodiments, the HVAC equipment 110 may include a first damper set 140, a second damper set 142, a third damper set 144, and a fourth damper set 146, which are respectively associated with the first zone 120, the second zone 122, the third zone 124, and the fourth zone 126. The first, second, third, and fourth damper sets 140, 142, 144, and 146 may be fluidly coupled to the HVAC system 138 via an air distribution system, such as a system of ductwork, which enables the damper sets 140, 142, 144, 146 to control a flow rate of conditioned air supplied to the zones 128 and a flow rate of return air drawn from the zones 128 via the HVAC system 138. Indeed, it should be understood that the first damper set 140, the second damper set 142, the third damper set 144, and the fourth damper set 146 may each include one or more supply air dampers and/or one or more return air dampers. For conciseness, the first damper set 140, the second damper set 142, the third damper set 144, and the fourth damper set 146 may be collectively or individually referred to herein as damper sets 150.

As noted above, the zone controller 104 may be communicatively coupled to the control devices 108 to enable the zone controller 104 to monitor and/or regulate a temperature, humidity, and/or other climate parameter within each of the zones 128 based on feedback received from the control devices 108. For example, the zone controller 104 may be configured to adjust a flow rate of conditioned air that is supplied to the zones 128 via the HVAC system 138 based on temperature measurements acquired by the control devices 108. In some embodiments, an occupant or resident of the building 10 may input a desired target temperature setpoint of the first zone 120 using, for example, the first control device 130. The first control device 130 may determine whether a current or measured temperature within the first zone 120 is within a threshold range of the target temperature setpoint of the first zone 120. If the current temperature within the first zone 120 deviates from the target temperature setpoint of the first zone 120 by a threshold amount, the first control device 130 may send a call for heating or cooling to the zone controller 104. In response, that the zone controller 104 may adjust a position the first damper set 140 to increase or decrease a flow rate of conditioned air supplied to the first zone 120 via the HVAC system 138.

For example, in embodiments where the HVAC system 138 is operating in a cooling mode and the current temperature within the first zone 120 exceeds the target temperature setpoint of the first zone 120 by the threshold amount, the first control device 130 may send a call for cooling to the zone controller 104. In response, the zone controller 104 may instruct the first damper set 140 to transition to an open position, or to a partially open position, thereby increasing a flow rate of conditioned air or cooled air that is supplied to the first zone 120 via the HVAC system 138. Accordingly, the HVAC system 138 may gradually reduce the current temperature within the first zone 120, such that the current temperature may approach the target temperature setpoint of the first zone 120. In accordance with the techniques described herein, the zone controller 104 may similarly control operation of the second, third, and fourth damper sets 142, 144, and 146 to regulate air flow conditioned by the HVAC system 138 and supplied to the second, third, and fourth zones 122, 124 and 126. In this manner, the zone controller 104 may ensure that a current temperature within each of the zones 128 remains within a threshold range of respective target temperature setpoints of the zones 128.

As noted above, the zone controller 104 generally or traditionally includes a damper support limit that is indicative of a particular quantity of dampers that the zone controller 104 may simultaneously operate at a given instance in time. For example, the zone controller 104 may include internal hardware or software limitations that enable the zone controller 104 to output an electrical current or a control signal that is suitable to simultaneously operate, for example, twenty dampers or less at a particular time. Accordingly, as used herein, the "damper support limit" of the zone controller 104 is indicative of a maximum quantity of dampers the zone controller 104 may effectively operate simultaneously or concurrently.

In some embodiments, when multiple zones 128 of the building 10 concurrently send a call for heating or cooling to the zone controller 104, a cumulative quantity of dampers associated with these zones 128 may exceed the damper support limit of the zone controller 104. For example, if the control devices 108 of the first and second zones 120 and 122 concurrently send a call for cooling to the zone controller 104, where the first damper set 140 of the first zone 120 includes fifteen dampers, the second damper set 142 of the second zone 122 includes six dampers, and the damper support limit of the zone controller 104 is twenty dampers, the damper support limit of the zone controller 104 is exceeded, such that the zone controller 104 may be unable to simultaneously operate all of the dampers in the first and second damper sets 140 and 142. Indeed, in such an example, the zone controller 104 may shut down or deactivate to prevent wear or overloading on certain electrical components of the zone controller 104.

Accordingly, embodiments of the present disclosure include a processor-executable algorithm or process, referred to herein as a zoning algorithm, which enables the zone controller 104 to sequentially operate the damper sets 150 when a request to operate a cumulative quantity of dampers at a particular time exceeds the damper support limit of the zone controller 104. Particularly, in the present example, the zoning algorithm may enable the zone controller 104 to first operate, for example, the first damper set 140 and, upon completing actuation of the first damper set 140, subsequently operate the second damper set 142. Indeed, it should be understood that the first damper set 140 and the second damper set 142 each include a quantity of individual dampers that is within the damper support limit of the zone controller 104. In this manner, the zoning algorithm may enable the zone controller 104 to control operation of an HVAC system that may include a total quantity of dampers that exceeds the damper support limit of the zone controller 104. The zoning algorithm may be executed by the processor 112 of the zone controller 104, the microprocessor 86 of the control panel 82, and/or any other suitable processor or controller of the HVAC system 138. As discussed below, the zoning algorithm may instruct the zone controller 104 to sequentially operate the damper sets 150 based on certain zone parameters associated with each of the zones 128, such as a user selected priority level of the zones 128 and/or an upper airflow limit of the zones 128.

In some embodiments, the zone controller 104 may be configured to determine a quantity of individual dampers that are associated with each of the zones 128 by referencing a zoning database that is stored within, for example, the memory device 114 of the zone controller 104 and/or the memory device 88 of the control panel 82. That is, the zoning database may store and catalogue a quantity of dampers that are respectively included in the first, second, third, and fourth damper sets 140, 142, 144 and 146. Additionally, the zoning database may store user-specified priority levels associated with the zones 128 and/or the upper airflow limits of the zones 128, which enable the zone controller 104 to determine an order in which to sequentially control the individual dampers sets 150 during operation of the HVAC system 138. Particularly, the zone controller 104 may reference the zoning database during execution of the zoning algorithm to determine an appropriate sequence by which to operate, for example, the first, second, third, and/or fourth damper sets 140, 142, 144 and/or 146 when the first, second, third, and/or fourth zones 120, 122, 124 and/or 126, respectively, send a call for heating or cooling to the zone controller 104.

Figure 7:
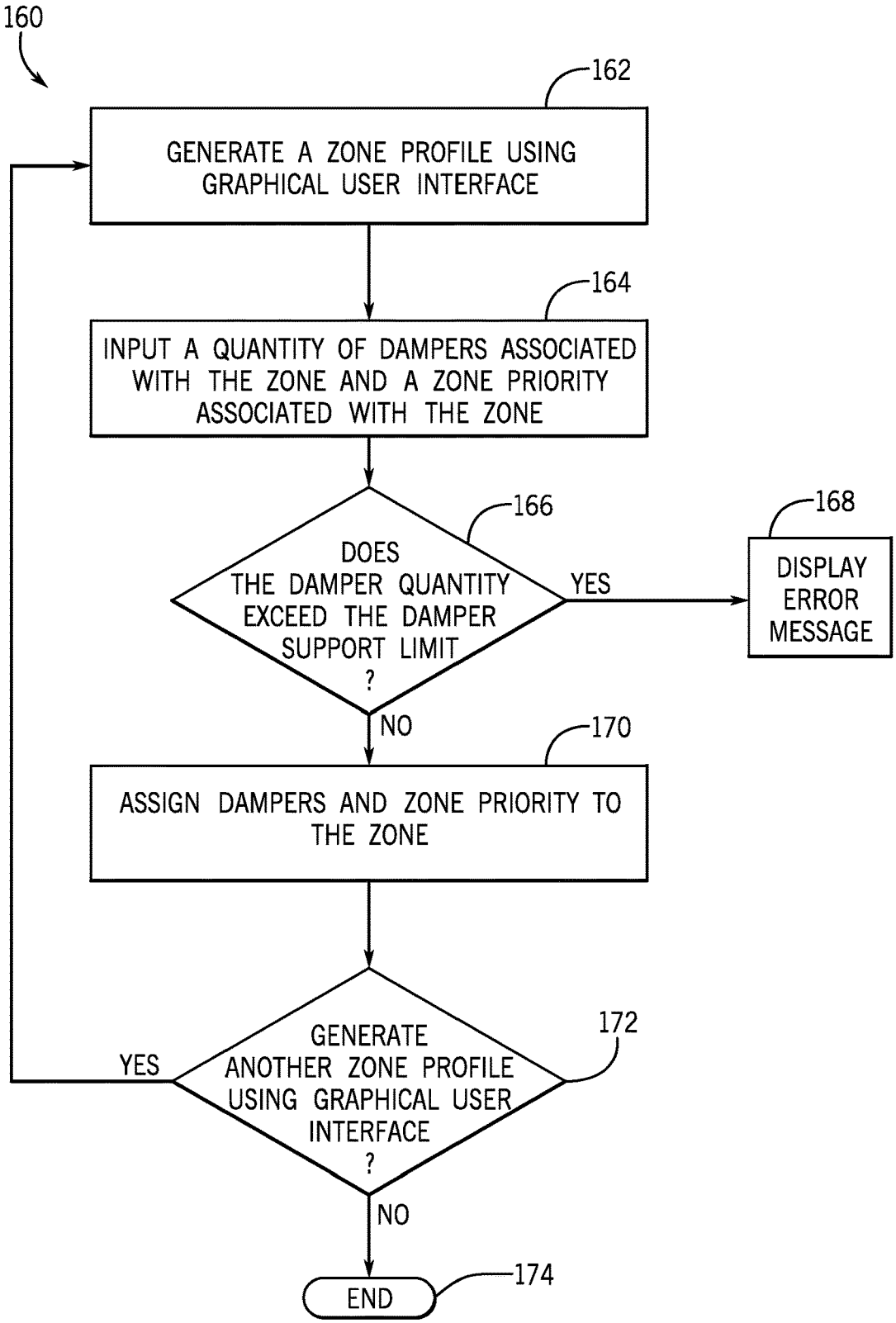
FIG. 7 is a flow diagram of an embodiment of a process for generating a zoning database for a control system, in accordance with an aspect of the present disclosure.

With the foregoing in mind, FIG. 7 is flow diagram of an embodiment of a process 160 that may be used to generate the zoning database. It should be appreciated that one or more of the steps discussed below may be performed during installation or initial set-up of the control system 102 and/or the HVAC system 138. For example, as discussed below with reference to FIGS. 10-16, a user may generate the zoning database by implementing the steps of process 160 on a GUI of the display device 106. In other embodiments, certain of the steps may be performed after the control system 102 is installed and operating within the building 10. For example, the control system 102 may gradually receive new and/or updated zone parameters, such as updated zone priority levels, during operation and/or after installation of the HVAC system 138. Moreover, it should be noted that the steps of the process 160 discussed below may be performed in any suitable order and are not limited to the order shown in the illustrated embodiment of FIG. 7. In some embodiments, the process 160 may be executed on the processor 112, the microprocessor 86, and/or any other suitable processor of the HVAC system 138.

In the illustrated embodiment, the process 160 begins with generating a zone profile for one of the zones 128 included in the building 10, as indicated by step 162. For example, the GUI of the display device 106 may prompt a user, such as an occupant of the building 10 or a service technician installing the control system 102, to generate a zone profile that is associated with, for example, the first zone 120. The GUI subsequently prompts the user to input certain zone parameters associated with the first zone 120, such as a quantity of dampers included in the first zone 120 and/or a desired priority level of the first zone 120, as indicated by step 164. For example, the GUI, via a touch-screen or another suitable input device of the display device 106, may enable the user to specify a quantity of dampers that are included within the first damper set 140, as well as a priority level of the first zone 120. As discussed below, in some embodiments, the priority levels of the zones 128 may be represented by non-repeating integer values. In certain embodiments, the GUI may also prompt the user to input an upper airflow limit of the first zone 120 at the step 164. As used herein, the "upper airflow limit" of a particular zone may be indicative of a suitable, upper flow rate of air the zone may receive from the HVAC system 138 to achieve a particular air exchange rate within that zone. In certain embodiments, the zoning algorithm may use the upper airflow limits associated with the zones 128 in addition to, or in lieu of, the priority levels of the zones 128 to determine an appropriate sequence in which to operate the damper sets 150 when a call for heating or cooling is sent to the zone controller 104 for multiple zones 128 or damper sets 150. It should be understood that, in other embodiments, the control system 102 may be communicatively coupled to any other suitable input device, such as a keyboard, a tracking pad, a microphone, a mouse, or the like, that is configured to receive a user input from a user and enable the user to generate the zoning database.

Continuing through the illustrated embodiment of the process 160, upon receiving the zone parameters of, for example, the first zone 120, via the GUI in the step 164, the zone controller 104 determines whether the user-associated quantity of dampers corresponding to the first zone 120 exceeds the damper support limit of the zone controller 104, as indicated by step 166. For example, in some embodiments, if the user attempts to associate the first zone 120 with a quantity of dampers that exceeds the damper support limit of the zone controller 104, the GUI may display an error message, as indicated by step 168. That is, the GUI may indicate that the user is attempting to associate the first damper set 140 with a quantity of dampers that exceeds a quantity of dampers that the zone controller 104 may simultaneously operate for a particular zone, such as for the first zone 120. If the user attempts to associate the first zone 120 with a quantity of dampers that is equal to or less than the damper support limit of the zone controller 104, the zone controller 104 may proceed to assign this user-associated quantity of dampers to the first zone 120, as indicated by step 170, and may store this user-selected zone parameter in the memory device 114. Additionally, at the step 170, the zone controller 104 may assign the user-selected priority level to the first zone 120. It should be noted that the damper support limit of the zone controller 104 may be stored within the memory device 114 and/or within another suitable memory device of the HVAC system 138 for reference during execution of the process 160.

Upon completion of a zone profile for a particular zone, the GUI may prompt the user to generate an additional zone profile, as indicated by the step 172, such as, for example, a zone profile corresponding to the second zone 122. Accordingly, based on user input, the zone controller 104 may return to the step 162, thereby enabling the user to input zone parameters associated with the second zone 122, such as a quantity of dampers included in the second zone 122, a user-selected priority level of the second zone 122, and/or an upper airflow limit associated with the second zone 122. As such, it should be understood that the steps 162, 164, 166, 170, and 172 may be repeated iteratively for each of the zones 128 of the building 10. Accordingly, with respect to the exemplary embodiment of the building 10 discussed herein, the zone controller 104 may store, via the memory device 114, a respective quantity of dampers, a respective priority level, and/or a respective upper airflow limit associated with the first, second, third, and fourth zones 120, 122, 124, and 126. Upon generation of the zone profiles for each of the zones 128, execution of the process 160 concludes, as indicated by step 174.

As noted above, in some embodiments, the priority levels of the zones 128 may include non-repeating integer values that are stored within the respective zone profiles of the zones 128. That is, each of the zones 128 may be assigned a unique priority level that is different than a priority level of other zones 128. Larger integer values may correspond to zones 128 having a higher priority than zones 128 associated with lower integer values. However, it should be noted that the priority levels may be generated via any other suitable numerical, alphabetic, or alphanumeric character code in other embodiments of the control system 102. Moreover, in certain embodiments, multiple zones 128 may be associated with the same priority level.

Figure 8:
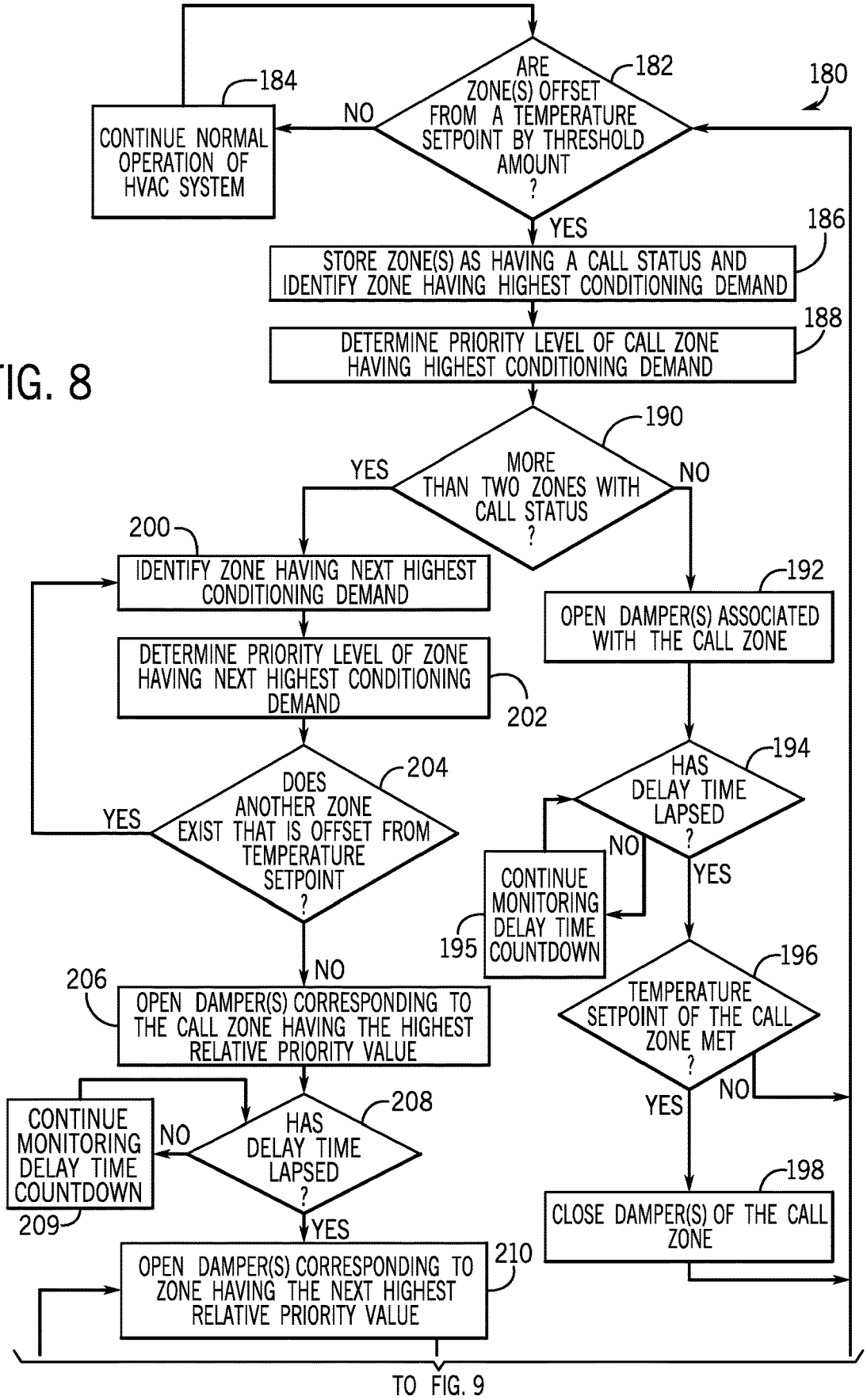
FIG. 8 is a flow diagram of an embodiment of a process for operating a zoned HVAC system using a control system, in accordance with an aspect of the present disclosure.
Figure 9:
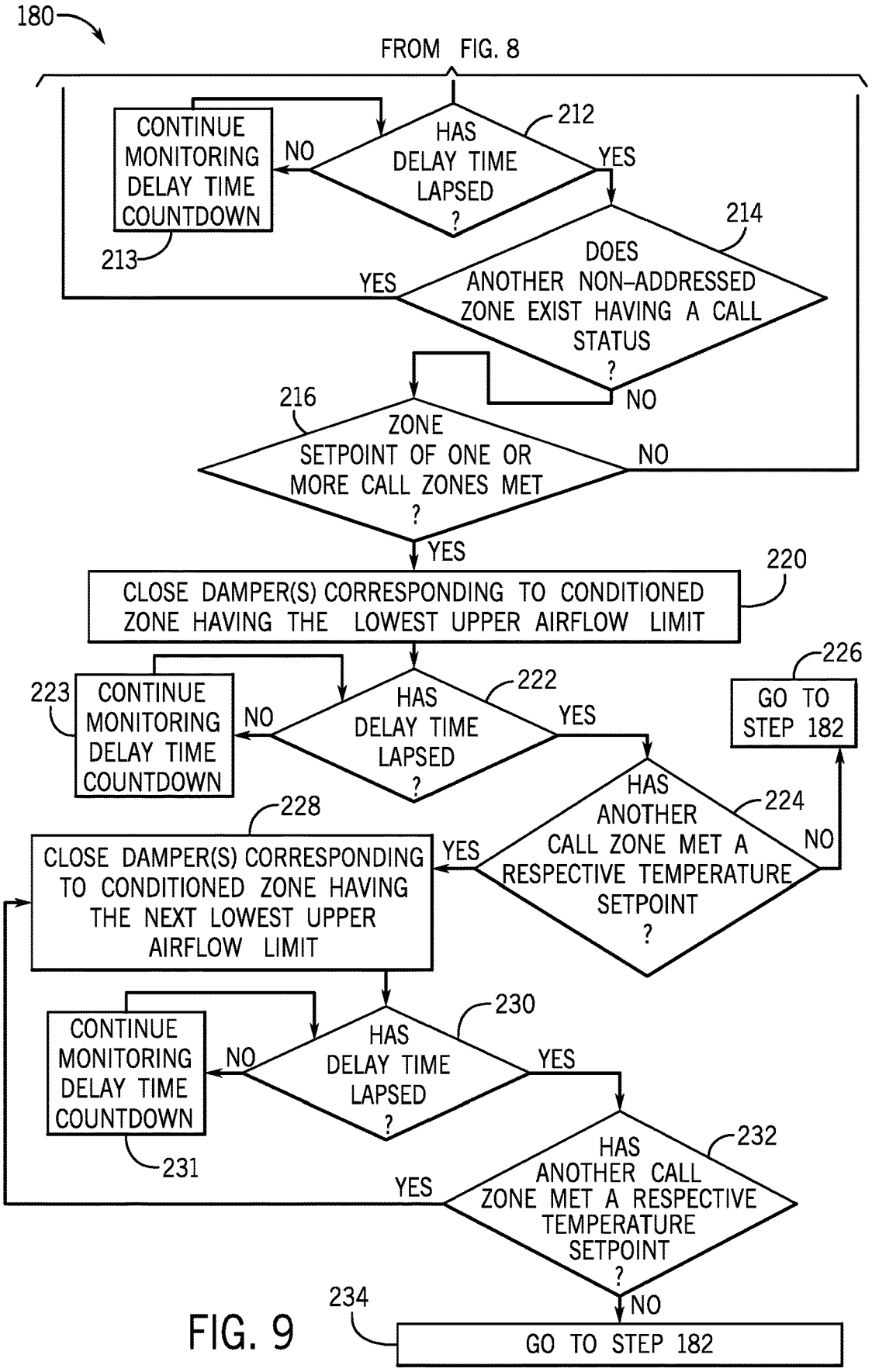
FIG. 9 is a flow diagram of an embodiment of additional steps that may be included in the process of FIG. 8, in accordance with an aspect of the present disclosure.

FIG. 8 is a flow diagram of an embodiment of a process 180, also referred to herein as the zoning algorithm, which may be used to operate the control system 102. FIG. 9 is a flow diagram that illustrates additional steps included in an embodiment of the process 180. FIGS. 8 and 9 are discussed concurrently below. It should be noted that one or more of the steps of the process 180 may be implemented using routines or code stored in the memory device 114 and may be executed by the processor 112 of the zone controller 104. Moreover, the steps of the process 180 may be executed in any suitable order and are not limited to the order shown in the illustrated embodiment of FIG. 8 and the order shown in the illustrated embodiment of FIG. 9. As discussed in detail below, the illustrated embodiment of the process 180 may be used to operate the zone controller 104 and the control system 102 in a manual mode of operation, in which the zone controller 104 and the control system 102 may be configured to control operation of the damper sets 150 based on the user-selected priority levels stored within the zoning database. However, in certain embodiments, the process 180 may also be used to operate zone controller 104 and the control system 102 in an automated mode of operation, in which the zone controller 104 and control system 102 may be configured to control operation of the damper sets 150 based on the respective upper airflow limits associated with each of the zones 128.

In the illustrated embodiment, the process 180 begins with determining whether one or more of the zones 128 are offset from a respective temperature setpoint by a threshold amount, as indicated by step 182. For example, as noted above, an occupant or resident of the building 10 may input a desired target temperature setpoint for each of the zones 128 using the control devices 108. The control devices 108 may determine whether current temperatures within the zones 128 are within a threshold range of respective target temperature setpoints associated with the zones 128. If none of the zones 128 have a current temperature that is offset from a corresponding temperature setpoint by the threshold amount, such as, for example, plus or minus 0.5 degrees Fahrenheit, the zone controller 104 continues normal operation of the HVAC system 138, as indicated by step 184. Accordingly, the zone controller 104 may continue to monitor the current temperatures within the zones 128, as indicated by the step 182.

If a current temperature within at least one of the zones 128 deviates from a respective target temperature setpoint by the threshold amount, the zone controller 104 stores such zone(s) 128 as having a call status, as indicated by step 186. Additionally, as indicated by step 186, the zone controller 104 identifies which of the zones 128 having a call status has the highest relative conditioning demand. That is, the zone controller 104 may determine respective temperature differentials between the current temperature values and the corresponding temperature setpoints for each of the zones having a call status and may identify the zone having the largest temperature differential between its current temperature value and its corresponding temperature setpoint. For clarity, as used herein, a zone having a "call status" may be indicative of a zone that sends a call for heating or cooling to the zone controller 104. In other words, a zone having a call status may be indicative of a zone having a current temperature that is offset from a corresponding target temperature setpoint of that zone by a threshold amount. Moreover, as user herein, a "call zone" may be indicative of a zone having a call status.

Continuing through the illustrated embodiment of the process 180, in the manual mode of operation, the zone controller 104 determines the priority level of the call zone having the highest relative conditioning demand, as indicated by step 188. That is, the zone controller 104 may reference the zoning database to determine the user-selected priority level associated with the call zone having the highest relative conditioning demand. In the automated mode of operation, at the step 188, the zone controller 104 may reference the zoning database to determine the upper airflow limit associated with the call zone having the highest relative conditioning demand. For conciseness, a call zone having a highest relative conditioning demand amongst the remaining call zones will be referred to herein as a "primary demand zone."

In the illustrated embodiment of the process 180, at step 190, the zone controller 104 determines whether the building 10 includes two or more call zones at the current iteration of the process 180. If the zone controller 104 identifies only a single call zone, the zone controller 104 instructs the dampers associated with this call zone to transition to an open position or to a partially open position, as indicated by step 192. For example, if the first zone 120 is the only one of the zones 128 having a call status, then the zone controller 104 instructs the first damper set 140 to transition to a fully open position or to a partially open position. In this manner, the zone controller 104 may increase a flow rate of conditioned air supplied to the first zone 120 to cause the current temperature within the first zone 120 to approach the target temperature setpoint of the first zone 120. Upon instructing the first damper set 140 to transition to the open position, the zone controller 104 may determine whether a designated delay time or a target delay time has lapsed, as indicated by step 194. As discussed in detail below, the delay time may be between about ten seconds and about 120 seconds and may ensure that the zone controller 104 provides sufficient time for a previously actuated damper set to transition to a desired position, such as an open position or a closed position, before the zone controller 104 actuates another damper set of the HVAC system 138. That is, in the present example, the delay time may ensure that the zone controller 104 provides a time interval that is sufficient to enable the first damper set 140 to transition to an open position before the zone controller 104 actuates other damper sets 150 of the HVAC system 138. In this manner, the delay time may ensure that an actuation period of a particular damper set does not overlap with an actuation period of another damper set. Accordingly, the delay time may ensure that the zone controller 104 does not attempt to simultaneously operate a quantity of dampers that exceeds the damper support limit of the zone controller 104.

If the zone controller 104 determines that the delay time has not fully lapsed, the zone controller 104 proceeds to monitor a countdown or timer associated with the delay time, as indicated by step 195. As indicated by step 196, upon a determination that the delay time has lapsed, the zone controller 104 determines whether a temperature setpoint within the call zone is met. That is, the zone controller 104 may determine whether an actual temperature within the call zone is within a threshold range of a target temperature setpoint of the call zone and thus determines that the call for heating or cooling in the call zone is satisfied. If the temperature setpoint of the call zone is not met, the zone controller 104 returns to the step 182. Accordingly, in embodiments where only a single zone, such as the first zone 120, is associated with a call status for heating or cooling, the zone controller 104 may iterate through the steps 182, 186, 188, 190, 192, 194, and 196 until the temperature setpoint of the call zone is met. For conciseness, each iteration of the steps the steps 182, 186, 188, 190, 192, 194, and 196 will be referred to herein as a single zone inspection cycle of the zone controller 104. In some embodiments, the zone controller 104 may skip the steps 192 and 194 in a subsequent iteration of the single zone inspection cycle if the damper set associated with the call zone has already transitioned to respective open positions or respective partially open positions in a previous iteration of the single zone inspection cycle. For example, in embodiments where the call zone is the first zone 120 and the zone controller 104 has already completed a first iteration of the single zone inspection cycle, the zone controller 104 may iterate through the steps 182, 186, 188, 190, and 196 until the temperature setpoint of the first zone 120 is achieved. If the temperature setpoint within the first zone 120 is met, the zone controller 104 may close the first damper set 140, as indicated by step 198, and may return to the step 182.

In embodiments where two or more of the zones 128 are associated with a call status at step 190, the zone controller 104 proceeds to step 200 and determines which of the zones 128 has the next highest conditioning demand subsequent to the primary demand zone. In other words, the zone controller 104 determines which of the zones 128 having a call status, other than the primary demand zone, includes a largest relative temperature differential between a respective target temperature setpoint of the zone and an actual temperature value within the zone. A call zone having a second highest relative conditioning demand amongst the call zones will be referred to herein as a "secondary demand zone."

In the manual mode of operation, the zone controller 104 references the zoning database to determine the user-selected priority level associated with the secondary demand zone, as indicated by step 202. Alternatively, in the automated mode of operation, at step 202, the zone controller 104 may reference the zoning database to determine the upper airflow limit associated with secondary demand zone. In any case, at step 204 of the process 180, the zone controller 104 may determine whether another one of the zones 128 includes a call status. If the zone controller 104 identifies another call zone, the zone controller 104 may repeat the steps 200, 202, and 204. Particularly, it should be understood that the zone controller 104 may repeat the steps 200, 202, and 204 for all call zones of the building 10. In this manner, the zone controller 104 may identify the secondary demand zone, a tertiary demand zone, a quaternary demand zone, and so forth, as well as determine a respective priority level or a respective upper airflow limit associated with the secondary demand zone, the tertiary demand zone, and the quaternary demand zone.

Continuing through the illustrated embodiment of the process 180, in the manual mode of operation, the zone controller 104 determines which call zone includes a highest relative priority level amongst the currently identified call zones, as indicated by step 206. The call zone having the highest relative priority level amongst the remaining call zones will be referred to herein as a "priority zone." Additionally, as indicated by the step 206, the zone controller 104 instructs the damper set associated with the priority zone to transition to an open position or to a partially open position. Accordingly, the zone controller 104 may enable the HVAC system 138 to initiate supply of conditioned air to the call zone having the highest relative user-selected priority level before initiating the supply of conditioned air to the remaining call zones. That is, upon identification of the priority zone, the zone controller 104 may control operation of the HVAC system 138 to condition air suitable for supply to the priority zone, thereby enhancing or accelerating a rate at which the priority zone is heated or cooled. It should be understood that the priority zone may include the primary demand zone, the secondary demand zone, the tertiary demand zone, or the quaternary demand zone. In other words, the priority zone is determined based on the highest relative user-selected priority level of the call zones instead of the cooling demands or the heating demands of the call zones.

After the zone controller 104 instructs the damper set of the priority zone to transition to an open position, the zone controller 104 determines whether the designated delay time has lapsed, as indicated by step 208. If the zone controller 104 determines that the delay time has not fully lapsed, the zone controller 104 proceeds to monitor a countdown or the timer associated with the delay time, as indicated by step 209. Upon a determination that the delay time has lapsed, the zone controller 104 identifies the call zone having a second highest relative priority level and instructs the damper set associated with this call zone to transition to an open position, as indicated by step 210. The call zone having the second highest relative priority level amongst the remaining call zones will be referred to herein as a "secondary priority zone." By waiting for the delay time to lapse, the zone controller 104 may ensure that the damper set associated with the priority zone is provided with a sufficient time interval to fully transition to a particular position, such as the open position, before the zone controller 104 attempts to operate the damper set associated with the secondary priority zone. Indeed, as noted above, the delay time may be indicative of a time period that enables a damper or a dampers associated with a particular zone to transition from a closed position to an open position, or vice versa. Therefore, the zoning algorithm may ensure that the zone controller 104 does not attempt to simultaneously operate damper sets of more than one of the call zones, which may cause the zone controller 104 to attempt to actuate a quantity of dampers at a particular instance in time that exceeds the damper support limit of the zone controller 104.

For example, if the damper support limit of the zone controller 104 is twenty dampers, if the priority zone includes a damper set having fifteen dampers, and if the secondary priority zone includes a damper set having six dampers, then the damper support limit of the zone controller 104 would be exceeded if the zone controller 104 attempts to concurrently operate the damper set of the secondary priority zone and the damper set of the priority zone. That is, in such an example, the damper support limit of the zone controller 104 would be exceeded if the zone controller 104 attempts to operate the damper set of the secondary priority zone before the damper set of the of the priority zone has completed transitioning from, for example, a closed position to an open position. Accordingly, by waiting for the delay time to lapse at the step 208, the zone controller 104 may ensure that the damper set associated with the priority zone has ceased operation before attempting to operate the damper set associated with the secondary priority zone. In this manner, the zoning algorithm may enable the zone controller 104 to operate an HVAC system that includes a total quantity of dampers that may exceed the damper support limit of the zone controller 104. Indeed, through such sequential operation of the damper sets 150, the zoning algorithm may enable the zone controller 104 to effectively control an HVAC system that includes a plurality of zones, where each of the zones includes a damper set having a quantity of dampers that is equal to, or less than, the damper support limit of the zone controller 104. However, it should be noted that, in some embodiments, the zone controller 104 may be configured to operate damper sets of multiple calls zones simultaneously if a cumulative quantity of dampers included in these call zones does not exceed the damper support limit of the zone controller 104.

Continuing through the illustrated embodiment of the process 180, after the zone controller 104 instructs the damper set of the secondary priority zone to transition to an open position at the step 210, the zone controller 104 again evaluates whether the delay time has lapsed, as indicated by step 212. If the zone controller 104 determines that the delay time has not fully lapsed, the zone controller 104 proceeds to monitor the timer associated with the delay time, as indicated by step 213. Upon lapse of the delay time, the zone controller 104 identifies whether additional call zones exist for which the zone controller 104 has not yet adjusted corresponding damper sets, as indicated by step 214. If the zone controller 104 identifies another zone having a call status, the zone controller 104 may repeat the steps 210, 212, and 214. Specifically, it should be understood that the zone controller 104 may repeat the steps 210, 212, and 214 for all of the remaining call zones, such that the zone controller 104 may sequentially open the damper sets associated with, for example, a tertiary priority zone, a quaternary priority zone, and so forth.

It is important to note that, in the automated mode of operation, the zone controller 104 may identify the priority zone, the secondary priority zone, the tertiary priority zone, the quaternary priority zone, and so forth, based on the previously assigned upper airflow limits associated with the zones 128, instead of the user-selected priority levels of the zones 128. For example, as noted above, an operator may use the display device 106 to assign a respective upper airflow limit to each of the zones 128 during installation or initial setup of the control system 102, which may be stored within the zoning database of the control system 102. Accordingly, when iterating through the steps of the process 180 in the automated mode of operation, the zone controller 104 may identify the priority zone as the call zone having a highest relative upper airflow limit amongst remaining call zones of the building 10. The zone controller 104 may identify the secondary priority zone as the call zone having the next highest relative upper airflow limit subsequent to the priority zone. The zone controller 104 may identify the tertiary priority zone as the call zone having the next highest relative upper airflow limit subsequent to the secondary priority zone, and so forth.

In embodiments, where two or more call zones include the same upper airflow limit, the zone controller 104 may assign the call zone having a higher cooling or heating demand with a higher relative priority status. For example, if the first zone 120 and the second zone 122 are both associated with the same upper airflow limit, if a current temperature of the first zone 120 is offset from a respective temperature setpoint by a first differential, if a current temperate of the second zone 122 is offset from a respective temperature setpoint by a second differential, and if the first differential is greater than the second differential, then the zone controller 104 will identify the first zone 120 as, for example, the priority zone, and may identify the second zone as the secondary priority zone. In any case, the zone controller 104 may iterate through the steps of the process 180 in the manner discussed above to sequentially open respective damper sets 150 of the call zones based on the upper airflow limits of these zones 128 and the cooling or heating demands of the zones 128. As discussed in detail below, a user may utilize the display device 106 to instruct the zone controller 104 to operate in the automated mode or the manual mode.

Regardless of whether the zone controller 104 operates in the manual mode or the automated mode, at step 216, the zone controller 104 determines whether a respective temperature setpoint of at least one call zone is met. If the temperature setpoint of no call zone is met, then zone controller 104 returns to the step 182 and proceeds to iterate through the process 180 until the HVAC system 138 sufficiently conditions at least one of the call zones to its corresponding temperature setpoint. Particularly, if the temperature setpoint of at least one call zone is met, the zone controller 104 may proceed to step 220. For clarity, a call zone that has been conditioned to have an actual temperature that is substantially equal to the target temperature of that call zone will be referred to herein as a "conditioned zone."

As shown in the illustrated embodiment of FIG. 9, the process 180 includes closing a damper or dampers of a conditioned zone that is associated with a lowest relative upper airflow limit, with respect to other conditioned zones, as indicated by step 220. For example, the zone controller 104 may reference the zoning database or a cache of the memory device 114 to determine which of the one or more conditioned zones includes a lowest relative upper airflow limit and, upon identification of the zone, may instruct the damper set associated with this zone to transition to a closed position or to a partially closed position. A conditioned zone having a lowest relative upper airflow limit of the remaining conditioned zones will be referred to herein as a "primary conditioned zone."

The process 180 further includes waiting for the delay time to lapse upon actuation of the damper set of the primary conditioned zone, as indicated by step 222. If the zone controller 104 determines that the delay time has not fully lapsed, the zone controller 104 proceeds to monitor the timer associated with the delay time, as indicated by step 223. Upon a determination that the delay time has lapsed, the zone controller 104 determines whether additional conditioned zones exist that have met their respective temperature setpoint, as indicated by step 224. If the zone controller 104 does not identify another conditioned zone in the current iteration of the process 180, then the zone controller 104 returns to the step 182, as indicated by step 226. Accordingly, the zone controller 104 may initiate another iteration of the process 180. In embodiments where the zone controller 104 identifies two or more conditioned zones, the zone controller 104 proceeds to identify the conditioned zone having the next lowest upper airflow limit subsequent to the primary conditioned zone and instructs the damper set of this zone to transition to a closed position, as indicated by step 228. In other words, the zone controller 104 determines which of the conditioned zones, other than the primary conditioned zone, includes a lowest relative upper airflow limit, and proceeds to instruct the damper set associated with this zone to transition to a closed position. A conditioned zone having a second lowest relative upper airflow limit amongst the conditioned zones will be referred to herein as a "secondary conditioned zone."

At step 230 of the process 180, the zone controller 104 evaluates the timer associated with the delay time and may remain idle until the delay time has lapsed, as indicated by step 231. Upon lapse of the delay time, the zone controller 104 determines whether another conditioned zone exists that has met its respective temperature setpoint. If the zone controller 104 identifies another conditioned zone, the zone controller 104 may repeat the steps 228, 230, and 232. Particularly, it should be understood that the zone controller 104 may repeat the steps 228, 230, and 232 for all conditioned zones within the building 10, such that the zone controller 104 may identify a tertiary conditioned zone, a quaternary conditioned zone, and so forth, as well as sequentially close respective damper sets associated with the tertiary conditioned zone, the quaternary conditioned zone, and/or any additional conditioned zones within the building 10. That is, the zone controller 104 may sequentially close or partially close respective dampers sets associated with these conditioned zones in ascending order of the respective upper airflow limits of the conditioned zones. Upon closing the damper sets of all conditioned zones, the zone controller 104 may return to the step 182 to perform another iteration of the process 180, as indicated by the step 234.

It should be appreciated that sequentially closing the damper sets based on the upper airflow limits associated with the conditioned zones may mitigate a likelihood of over conditioning the zones via the HVAC system 138. For example, as noted above, the upper airflow limits of the zones 128 may be indicative of air flow rates that enable the HVAC system 138 to achieve a particular air exchange rate within the zones 128. Accordingly, in certain embodiments, zones 128 associated with relatively small upper airflow limits may be indicative of zones 128 having a relatively small interior volume, while zones 128 associated with a relatively large upper airflow limits may be indicative of zones 128 having relatively large interior volumes. As such, zones 128 having a low upper airflow limit may be more susceptible to over conditioning than zones 128 having a high upper airflow limit. Therefore, by sequentially closing damper sets of the conditioned zones in ascending order of the upper airflow limits associated with the conditioned zones, the zone controller 104 may mitigate a likelihood of over conditioning zones 128 having relatively small interior volumes. That is, by closing damper sets associated with relatively small zones 128 before closing damper sets associated with larger zones 128, the zone controller 104 may mitigate a likelihood of over conditioning smaller zones 128 of the building 10.

Figures 10, 11, 12, 13:
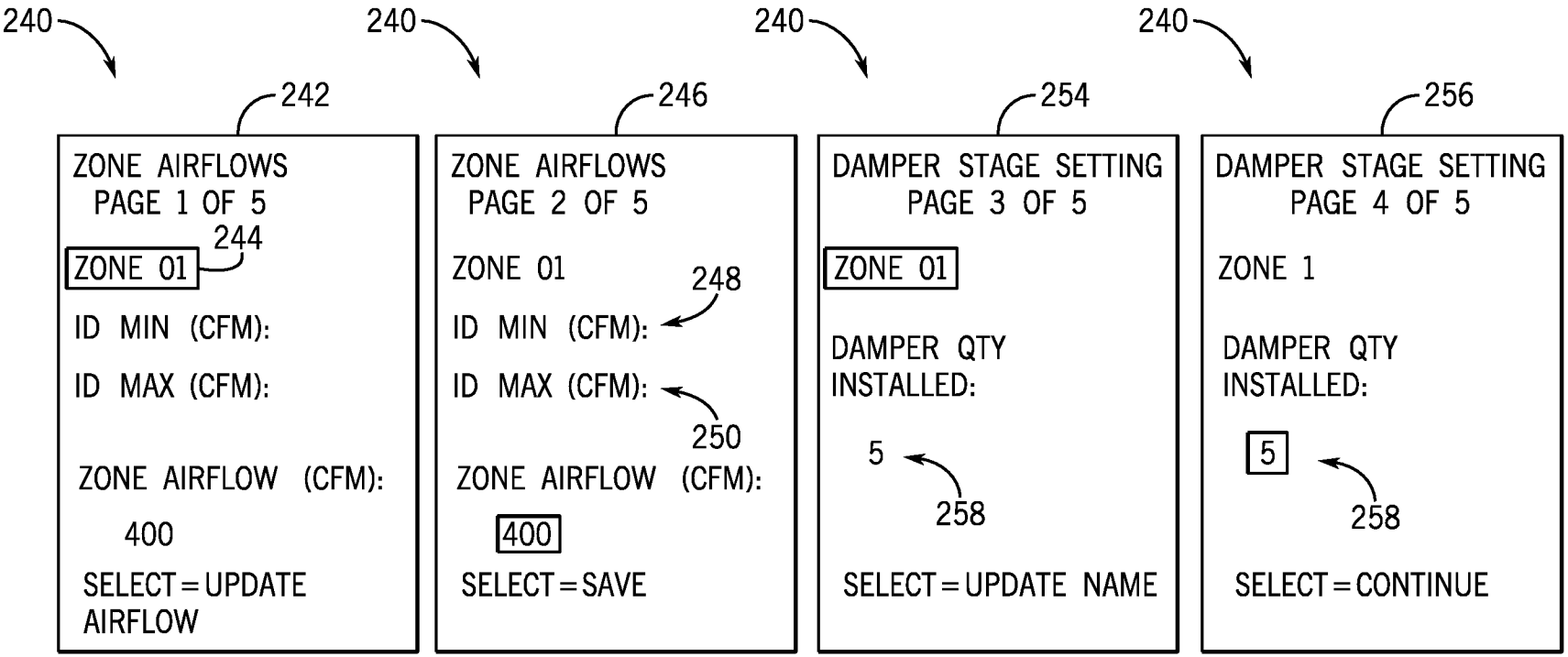
FIG. 10 is an illustration of an embodiment of a first screen of a graphical user interface that may be used to facilitate generation of a zoning database for a control system, in accordance with an aspect of the present disclosure.
FIG. 11 is an illustration of an embodiment of a second screen of a graphical user interface that may be used to facilitate generation of a zoning database for a control system, in accordance with an aspect of the present disclosure.
FIG. 12 is an illustration of an embodiment of a third screen of a graphical user interface that may be used to facilitate generation of a zoning database for a control system, in accordance with an aspect of the present disclosure.
FIG. 13 is an illustration of an embodiment of a fourth screen of a graphical user interface that may be used to facilitate generation of a zoning database for a control system, in accordance with an aspect of the present disclosure.

FIG. 10 is an illustration of an embodiment of a graphical user interface (GUI) 240 that may be displayed on the display device 106 to enable a user to generate the zoning database in accordance with the steps of the process 160. FIGS. 11-16 are illustrations of various screens that may be included in the GUI 240, which may further facilitate generation of the zoning database. As shown in the illustrated embodiment of FIG. 10, a first screen 242 of the GUI 240 may include a zone selection field 244 that enables a user to select and/or generate a zone profile for a particular zone 128. For example, the user may instruct the zone controller 104, via the GUI 240, to generate a zone profile for the first zone 120, which may be indicated as "Zone 01" in the GUI 240.

Figures 14, 15, 16:
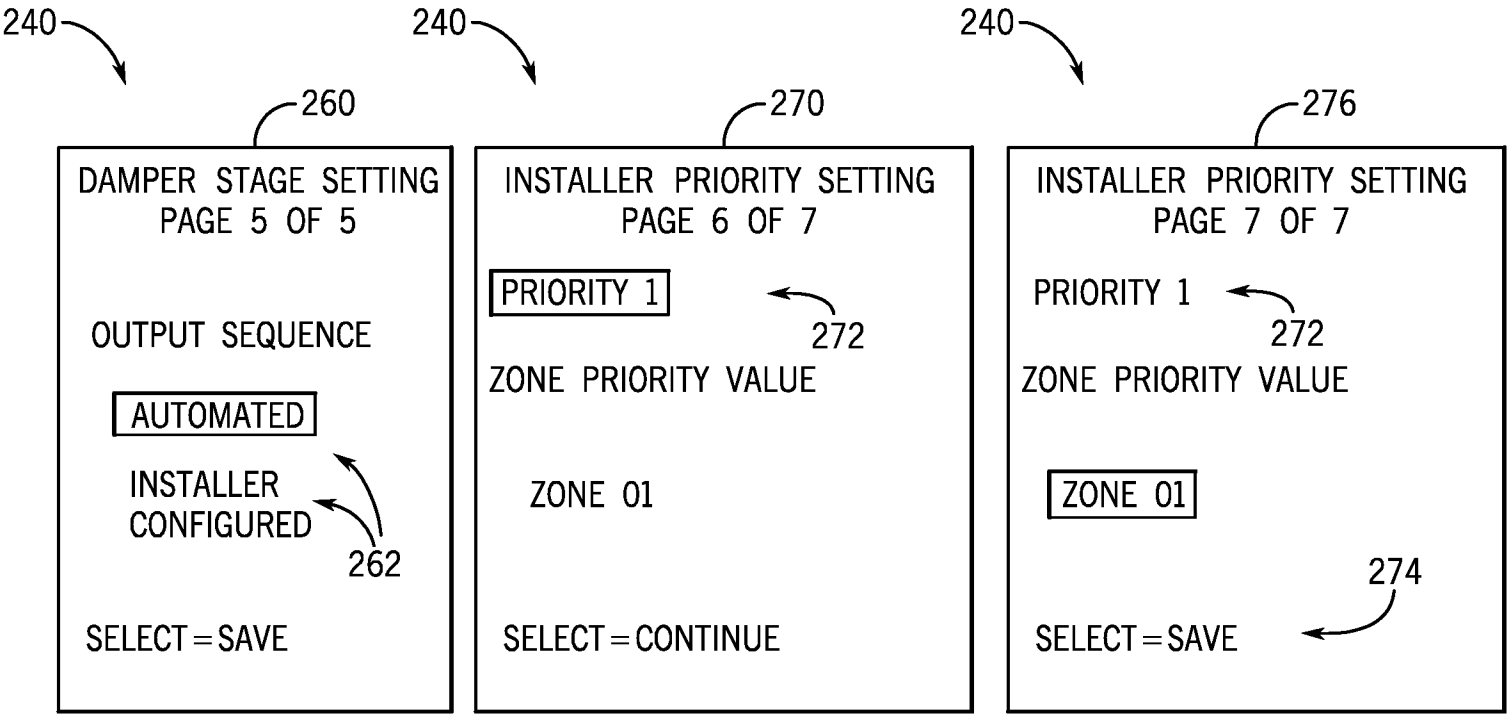
FIG. 14 is an illustration of an embodiment of a fifth screen of a graphical user interface that may be used to facilitate generation of a zoning database for a control system, in accordance with an aspect of the present disclosure.
FIG. 15 is an illustration of an embodiment of a sixth screen of a graphical user interface that may be used to facilitate generation of a zoning database for a control system, in accordance with an aspect of the present disclosure.
FIG. 16 is an illustration of an embodiment of a seventh screen of a graphical user interface that may be used to facilitate generation of a zoning database for a control system of an HVAC system, in accordance with an aspect of the present disclosure.

As shown in FIG. 11, the user may toggle to a second screen 246 of the GUI 240 that includes a lower airflow limit selection field 248 and an upper airflow limit selection field 250, which enable the user to specify a lower airflow limit and an upper airflow limit of, for example, the first zone 120. However, in other embodiments, the lower airflow limit selection field 248 and the upper airflow limit selection field 250 may auto-populate based on the type of HVAC system to which the display device 106 is coupled. The GUI 240 enables a user to specify a quantity of dampers included within a damper set of a particular zone via a third screen 254 and a fourth screen 256 of the GUI 240, as respectively shown in FIGS. 12 and 13. For example, the user may specify a quantity of dampers included in the first damper set 140 of the first zone 120 via a damper selection field 258. As discussed above, in some embodiments, the GUI 240 may display an error message if the user attempts to associate the first zone 120, or any other zone of the building 10, with a quantity of dampers that exceeds the damper support limit of the zone controller 104. The GUI 240 may include a fifth screen 260, as shown in FIG. 14, which enables the user to instruct the control system 102 to operate in the automated mode or the manual mode via a mode selection field 262. In embodiments where the user selects the automated mode, the GUI 240 may return to the first screen 242. Accordingly, the user may iteratively toggle through the first, second, third, fourth, and fifth screen 242, 246, 254, 256, and 260 to specify the lower airflow limit, the upper airflow limit, and the quantity of dampers associated with remaining zones 128 of the building 10. However, in embodiments where the user selects the manual mode, shown in FIG. 14 as the "installer configured" mode of operation, the GUI 240 may proceed to display a sixth screen 270, as shown in FIG. 15.

Specifically, via the sixth screen 270, the user may specify a priority level associated with each of the zones 128. For example, the user may specify a priority level of the first zone 120 via a zone priority field 272. The user may confirm and assign the selected priority level with the first zone 120 by selecting a save selection field 274, as shown in FIG. 16, which is displayed on a seventh screen 276, as shown in FIG. 16, of the GUI 240. As such, the user may iterate across the first through seventh screen 242, 246, 254, 256, 260, 270, and 276 of the GUI 240 to generate the zoning database.

As set forth above, embodiments of the present disclosure may provide one or more technical effects useful for enabling an individual zone controller 104 to operate an HVAC system that includes more dampers than a quantity of dampers allotted by a damper support limit of the zone controller 104. Indeed, the control system 102 of the present disclosure enables the zone controller 104 to sequentially control operation of various damper sets in the building 10, such that the zone controller 104 does not, at a particular instance in time, attempt to operate a total quantity of dampers that exceeds the damper support limit of the zone controller 104. That is, the control system 102 may ensure that the zone controller 104 does not attempt to operate two or more damper sets simultaneously if a total quantity of dampers included in the two or more damper sets exceeds the damper support limit of the zone controller 104. Indeed, in this manner, the control system 102 may ensure that the zone controller 104 is not overloaded during operation of the HVAC system 138. Accordingly, by enabling an individual zone controller 104 to control HVAC systems having a relatively large quantity of dampers, the present control system 102 may reduce an installation complexity of the HVAC systems, as well as decrease operational costs and/or maintenance costs associated with the HVAC systems. The technical effects and technical problems in the specification are examples and are not limiting. It should be noted that the embodiments described in the specification may have other technical effects and can solve other technical problems.

While only certain features and embodiments of the present disclosure have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A zoning system for a heating, ventilation, and/or air conditioning (HVAC) system having a plurality of zones, comprising:

a controller having a damper support limit, wherein the controller is configured to:

receive a first call for conditioning from a first zone that includes a first plurality of dampers and receive a second call for conditioning from a second zone that includes a second plurality of dampers, wherein a sum of the first plurality of dampers and the second plurality of dampers exceeds the damper support limit of the controller such that a cumulative quantity of dampers to be actuated at a particular time exceeds the damper support limit of the controller;

determine a first user-selected zone priority level of the first zone and a second user-selected zone priority level of the second zone, wherein the first user-selected zone priority level and the second user-selected zone priority level indicate relative priority values of the first zone and the second zone with respect to one another; and control operation of the HVAC system to sequentially actuate the first plurality of dampers and the second plurality of dampers based on the first user-selected zone priority level of the first zone and the second user-selected zone priority level of the second zone to satisfy the first call for conditioning and the second call for conditioning and to operate a damper sum within the damper support limit of the controller.

2. The zoning system of claim 1, wherein controller is configured to:

reference a zoning database to determine the first user-selected zone priority level of the first zone and the second user-selected zone priority level of the second zone, wherein the zoning database is configured to store user input indicative of the first user-selected zone priority level of the first zone and the second user-selected zone priority level of the second zone.

3. A control system for a zoned heating, ventilation, and/or air conditioning (HVAC) system including a plurality of zones, comprising:

a controller having a damper support limit, wherein the controller is configured to:

receive a call for conditioning from each of two zones of the plurality of zones, wherein each zone of the two zones includes a damper set, wherein a sum of dampers included in the damper sets of the two zones exceeds the damper support limit of the controller such that a cumulative quantity of dampers to be actuated at a particular time exceeds the damper support limit of the controller;

determine a user-selected zone priority level of each zone of the two zones to identify relative priority values of the two zones with respect to one another; and control operation of the zoned HVAC system to sequentially open the damper sets of the two zones based on the user-selected zone priority levels of the two zones to satisfy the call for conditioning of each of the two zones and to operate a quantity of dampers within the damper support limit of the controller.

4. The control system of claim 3, wherein, to control the operation of the zoned HVAC system to sequentially open the damper sets of the two zones based on the user-selected zone priority levels of the two zones, the controller is configured to:

determine a priority zone of the two zones, the priority zone having a highest user-selected zone priority level among the two zones;

instruct the damper set of the priority zone to open at a first time;

determine a secondary priority zone of the two zones, the secondary priority zone having a second highest user-selected zone priority level among the two zones; and instruct the damper set of the secondary priority zone to open at a second time in response to a determination that a designated delay time has lapsed between the first time and the second time.

5. The control system of claim 4, wherein the controller is configured to transition each damper of the damper set of the priority zone from a closed position to an open position prior to lapse of the designated delay time.

6. The control system of claim 3, wherein the user-selected zone priority level of each zone of the two zones comprises a numerical value, an alphabetic value, or an alphanumeric character code.

7. The zoning system of claim 1, wherein the first-user user-selected zone priority level and the second user-selected zone priority level comprise numerical values, alphabetic values, or alphanumeric character codes.

8. The zoning system of claim 1, wherein, to control operation of the HVAC system to sequentially actuate the first plurality of dampers and the second plurality of dampers, the controller is configured to actuate the first plurality of dampers at a first time based on the first user-selected zone priority level and to the actuate the second plurality of dampers at a second time based on the second user-selected zone priority level, wherein the first time and the second time are different.

* * * * *